US012534841B2

(12) United States Patent
Dunn et al.

(10) Patent No.: US 12,534,841 B2
(45) Date of Patent: Jan. 27, 2026

(54) COMBINATION LAUNDRY APPLIANCE AND METHOD FOR OPERATION

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US); Bystrik Cervenka, Nuremberg (DE)

(73) Assignee: Haier US Appliance Solutions, Inc., Wilmington, DE (US)

( * ) Notice: Subject to any disclaimer, the term of this patent is extended or adjusted under 35 U.S.C. 154(b) by 147 days.

(21) Appl. No.: 18/350,423

(22) Filed: Jul. 11, 2023

(65) Prior Publication Data

US 2025/0019882 A1 Jan. 16, 2025

(51) Int. Cl.

| | |
|---|---|
| ***D06F 33/60*** | (2020.01) |
| ***D06F 25/00*** | (2006.01) |
| ***D06F 33/68*** | (2020.01) |
| ***D06F 37/04*** | (2006.01) |
| ***D06F 58/04*** | (2006.01) |
| ***D06F 58/20*** | (2006.01) |
| *D06F 105/30* | (2020.01) |
| *D06F 105/48* | (2020.01) |
| *D06F 105/52* | (2020.01) |

(52) U.S. Cl.

CPC ..... *D06F 33/60* (2020.02); *D06F 25/00* (2013.01); *D06F 33/68* (2020.02); *D06F 37/04* (2013.01); *D06F 58/04* (2013.01); *D06F 58/20* (2013.01); *D06F 2105/30* (2020.02); *D06F 2105/48* (2020.02); *D06F 2105/52* (2020.02)

(58) Field of Classification Search

CPC ..... D06F 25/00; D06F 33/60; D06F 33/63; D06F 33/64; D06F 33/68; D06F 58/04; D06F 58/20; D06F 58/26; D06F 58/30; D06F 58/32; D06F 58/34; D06F 58/36; D06F 58/38; D06F 58/42; D06F 2105/30; D06F 2105/32; D06F 2105/48; D06F 2105/52; D06F 34/26; D06F 35/007

See application file for complete search history.

(56) References Cited

U.S. PATENT DOCUMENTS

| | | | |
|---|---|---|---|
| 10,344,420 B2 | 7/2019 | Cho et al. | |
| 2018/0057995 A1* | 3/2018 | Kim | D06F 58/26 |

FOREIGN PATENT DOCUMENTS

| | | |
|---|---|---|
| JP | 2010022497 A | 2/2010 |
| KR | 101604691 B1 | 3/2016 |

OTHER PUBLICATIONS

Machine Translation of Ishikawa et al., JP 2010-022497, Feb. 2010. (Year: 2010).*

* cited by examiner

*Primary Examiner* — David G Cormier

(74) *Attorney, Agent, or Firm* — Dority & Manning, P.A.

(57) ABSTRACT

A combination washer/dryer laundry appliance is provided, including a cabinet, a tub, a laundry basket forming a chamber for washing/drying laundry articles, a drying system and a blower configured to generate a flow of fluid through a flowpath including the chamber and the drying system, and a controller. The controller is configured to execute operations that include performing, at the laundry basket, a spin cycle, and operating the blower to inhibit the flow of fluid through a rear wall perforation at the laundry basket and a plenum between the laundry basket and the tub during the spin cycle.

20 Claims, 7 Drawing Sheets

COMBINATION LAUNDRY APPLIANCE AND METHOD FOR OPERATION

FIELD OF THE INVENTION

The present subject matter relates generally to laundry appliances, and more particularly to combination laundry appliances that perform both washing and drying operations.

BACKGROUND OF THE INVENTION

Combination laundry appliances, sometimes also referred to as washer/dryer appliances, provide both washing and drying functions in a single unit. Combination laundry appliances are therefore advantageous for added convenience and space saving.

Combination washer/dryer laundry appliances are configured to perform a wash cycle and generally include a spin cycle. However, inefficient spin cycles may result in relatively high moisture content remaining in the laundry articles, requiring a longer spin cycle to remove moisture, a longer drying cycle to dry articles, or both. Increased cycle times generally result in undesired increases in energy consumption.

Some embodiments of combination washer/dryer laundry appliances may include holes through the wash/dry basket to allow fluid to flow through the chamber. However, while holes positioned at the rear wall of the laundry basket may improve washing or drying in some aspects, such holes may generate pressure differentials during the spin cycle that undesirably retain or circulate moisture to the wash/dry chamber.

Accordingly, a combination laundry appliance addressing such issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a combination washer/dryer laundry appliance. The laundry appliance includes a cabinet defining an interior volume. A tub is mounted within the interior volume of the cabinet. A laundry basket is rotatably mounted within the tub, the laundry basket defining a chamber for the receipt of laundry articles. The laundry basket includes a rear wall perforation in fluid communication with a plenum formed between the laundry basket and the tub. A drying system is coupled to the tub. The drying system is in fluid communication with the chamber. The drying system is configured to receive a flow of fluid from the chamber and remove moisture from the flow of fluid and provide the dried air to the chamber. A blower is positioned at a flowpath including the drying system and the chamber. The blower is configured to urge the flow of fluid through the flowpath. A controller is configured to store instructions that, when executed, causes the controller to execute operations. The operations include performing, at the laundry basket, a spin cycle; and operating the blower to inhibit the flow of fluid through the plenum and rear wall perforation during the spin cycle.

Another aspect of the present disclosure is directed to a method for operating a combination washer/dryer laundry appliance. The method includes performing, at a laundry basket, a spin cycle; and operating a blower to inhibit a flow of fluid through a plenum formed between the laundry basket and a tub, and a rear wall perforation at the laundry basket during the spin cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
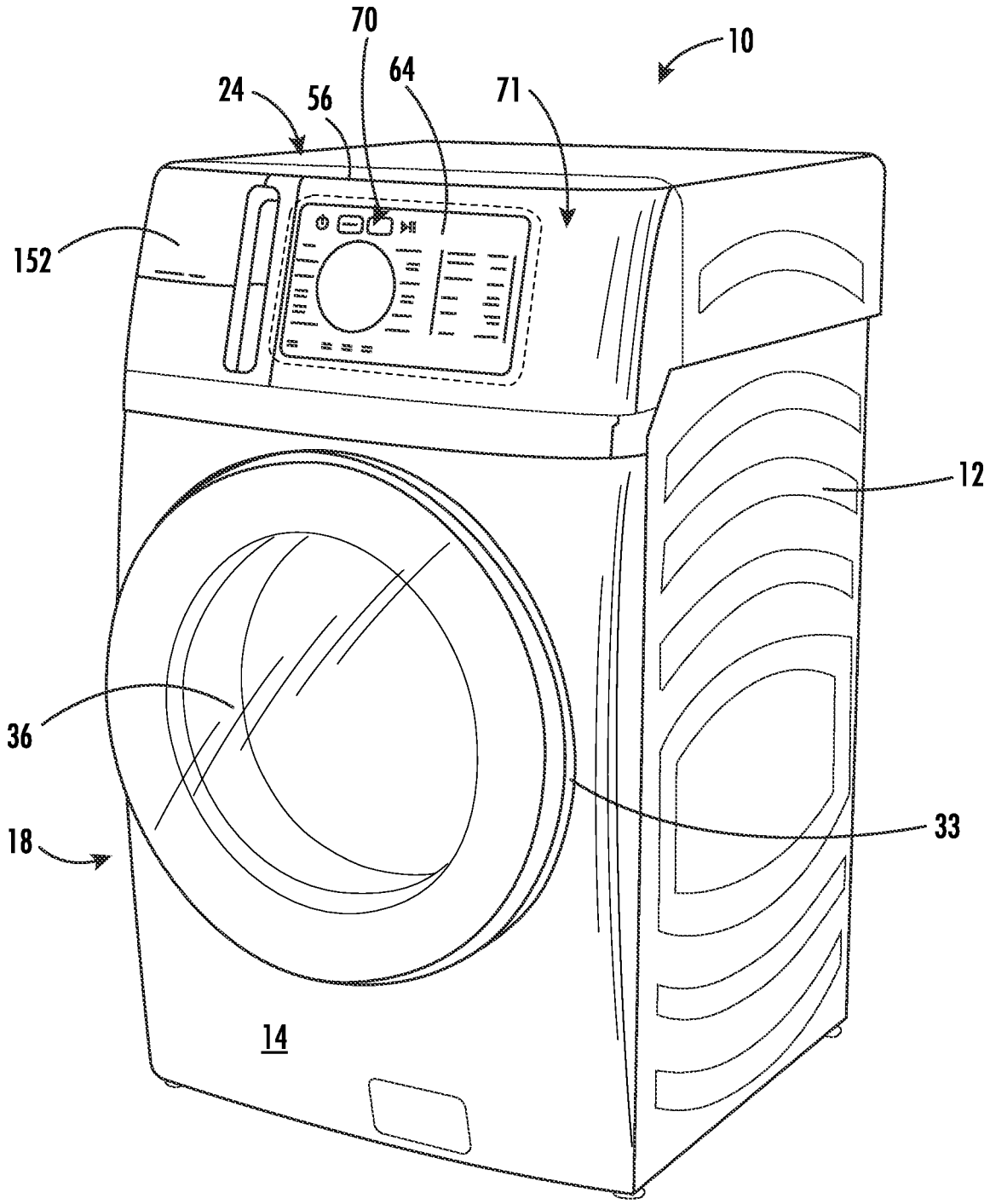
FIG. 1 provides a perspective view of a laundry appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
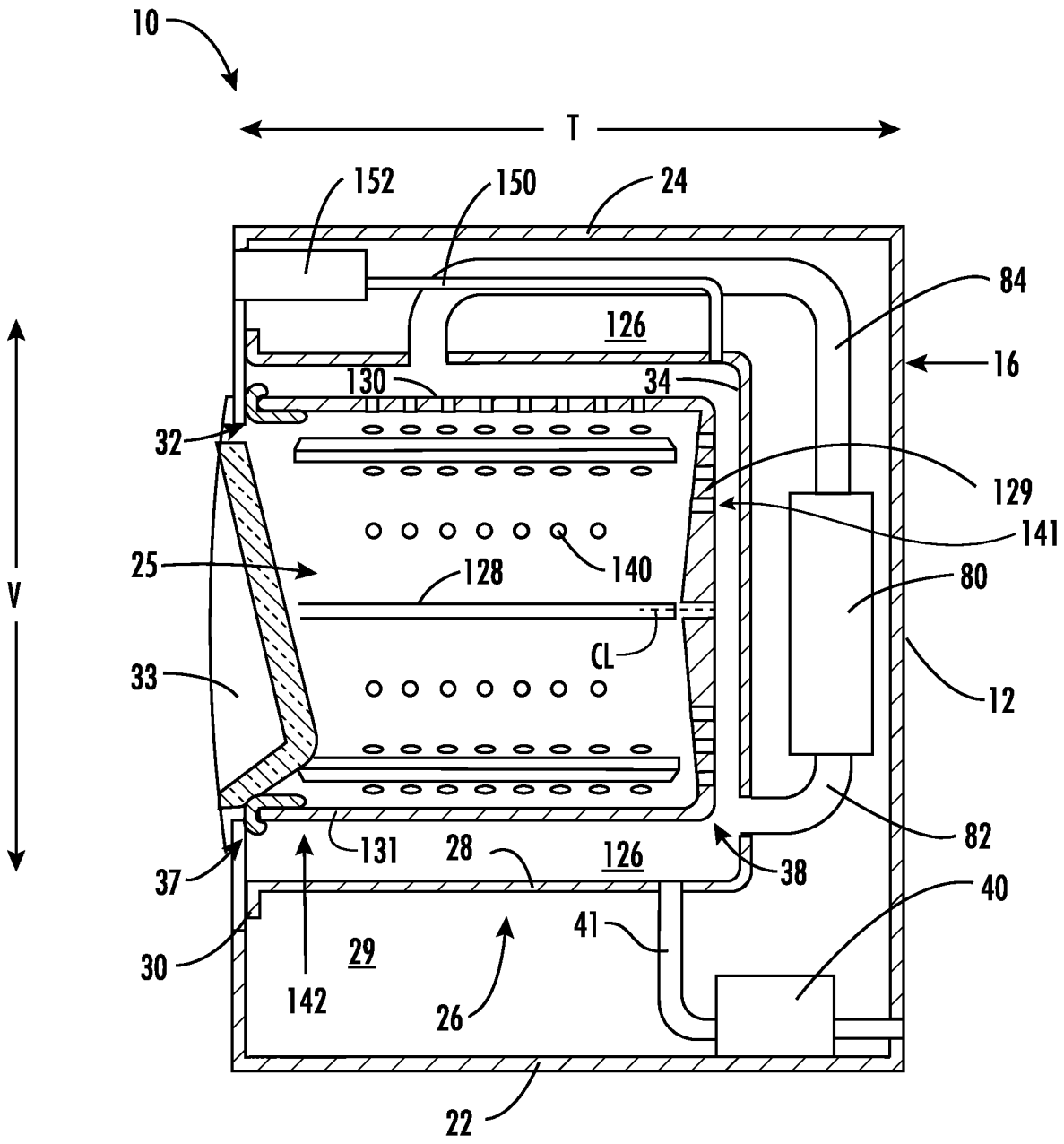
FIG. 2 provides a cross-section view of the example laundry appliance of FIG. 1.

Turning now to the figures, FIG. 1 provides a perspective view of a laundry appliance 10 according to exemplary embodiments of the present disclosure. The laundry appliance 10 is a combination laundry appliance, and may also be referred to as a multifunction laundry appliance or washer/dryer combination appliance. FIG. 2 provides a section view of laundry appliance 10. The laundry appliance 10 generally defines a vertical direction V, a lateral direction L, and a transverse direction T, each of which is mutually perpendicular, such that an orthogonal coordinate system is defined. While described in the context of a specific embodiment of laundry appliance 10, using the teachings disclosed herein, it will be understood that laundry appliance 10 is provided by way of example only. Other laundry appliances having different appearances and different features may also be utilized with the present subject matter as well.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

Cabinet 12 includes a front panel 14, a rear panel 16, a left side panels 18 and a right side panel 20 spaced apart from each other by front and rear panels 14 and 16, a bottom panel 22, and a top cover 24. As used herein, terms such as "left" and "right" or "front" and "back" refer to directions from the perspective of a user facing the laundry appliance 10 for accessing and/or operating the laundry appliance 10. For example, a user stands in front of the laundry appliance 10, e.g., at or near the front panel 14, to access door 33 and/or inputs 70 (the door 33 and inputs 70 are described in more detail below). Within cabinet 12, an interior volume 29 is defined. A drum or tub 26 is mounted within the interior volume 29. A laundry basket 130 is mounted within the tub 26. The laundry basket 130 defines a chamber 25 for receipt of articles of clothing for treatment, e.g., washing, rinsing, spinning, tumbling, and/or drying.

In some embodiments, one or more selector inputs 70, such as knobs, buttons, touchscreen interfaces, etc., may be provided or mounted on the cabinet 12, e.g., on a control panel 71 thereof and are in operable communication (e.g., electrically coupled or coupled through a wireless network band) with a processing device or controller 56. The control panel 71 may also include a display 64. Controller 56 may also be provided in operable communication with various components of the washer/dryer appliance 10, such as the motor, blower, and/or drying system 80. In turn, signals generated in controller 56 direct operation of such components in response to the position of inputs 70. As used herein, "processing device" or "controller" may refer to one or more microprocessors, microcontroller, ASICS, or semiconductor devices and is not restricted necessarily to a single element. The controller 56 may be programmed to operate laundry appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Tub 26 extends between a front portion 37 and a back portion 38. Tub 26 is generally cylindrical in shape, having an outer cylindrical wall 28 and a front flange or wall 30 that defines an opening 32 of tub 26, e.g., at front portion 37 of tub 26, for loading and unloading of articles into and out of a chamber 25 defined by and within a laundry basket 130 inside of the tub 26. Tub 26 includes a rear wall 34 opposite the front flange 30. A door 33 provides for closing or accessing tub 26 through opening 32. A window 36 (FIG. 1) may be provided in door 33 for viewing of the chamber 25 and/or laundry articles therein, e.g., during operation of the laundry appliance 10.

Laundry basket 130 is rotatably mounted within tub 26 such that the laundry basket 130 is rotatable about an axis of rotation CL. According to the illustrated embodiment, the axis of rotation is substantially parallel to the transverse direction T. In this regard, laundry appliance 10 is generally referred to as a "horizontal axis" or "front load" laundry appliance 10. However, it should be appreciated that aspects of the present subject matter may be used within the context of a vertical axis or top load laundry appliance as well.

Laundry appliance 10 includes a motor assembly (not shown) that is in mechanical communication with laundry basket 130 to selectively rotate laundry basket 130. The motor assembly may be a pancake motor or any other suitable type, size, or configuration of motor may be used to rotate laundry basket 130 according to various embodiments.

Laundry basket 130 includes a rear wall 129 extending along the vertical direction V and a sidewall 131 extending from the rear wall 129 along the transverse direction T. Laundry basket 130 may define one or more agitator features that extend into chamber 25 to assist in agitation and cleaning of articles disposed within laundry chamber 25 during operation of laundry appliance 10. For example, as illustrated in FIG. 2, a plurality of ribs 128 extends from laundry basket 130 into chamber 25. In this manner, for example, ribs 128 may lift articles disposed in laundry basket 130 during rotation of laundry basket 130, such as during an agitation or rinse portion of a wash operation of the laundry appliance 10. During a drying operation of the laundry appliance 10, the ribs 128 may also lift articles in the chamber 25 of the laundry basket 130 and then allow such articles to tumble back to a bottom of laundry basket 130 as laundry basket 130 rotates.

Figure 3:
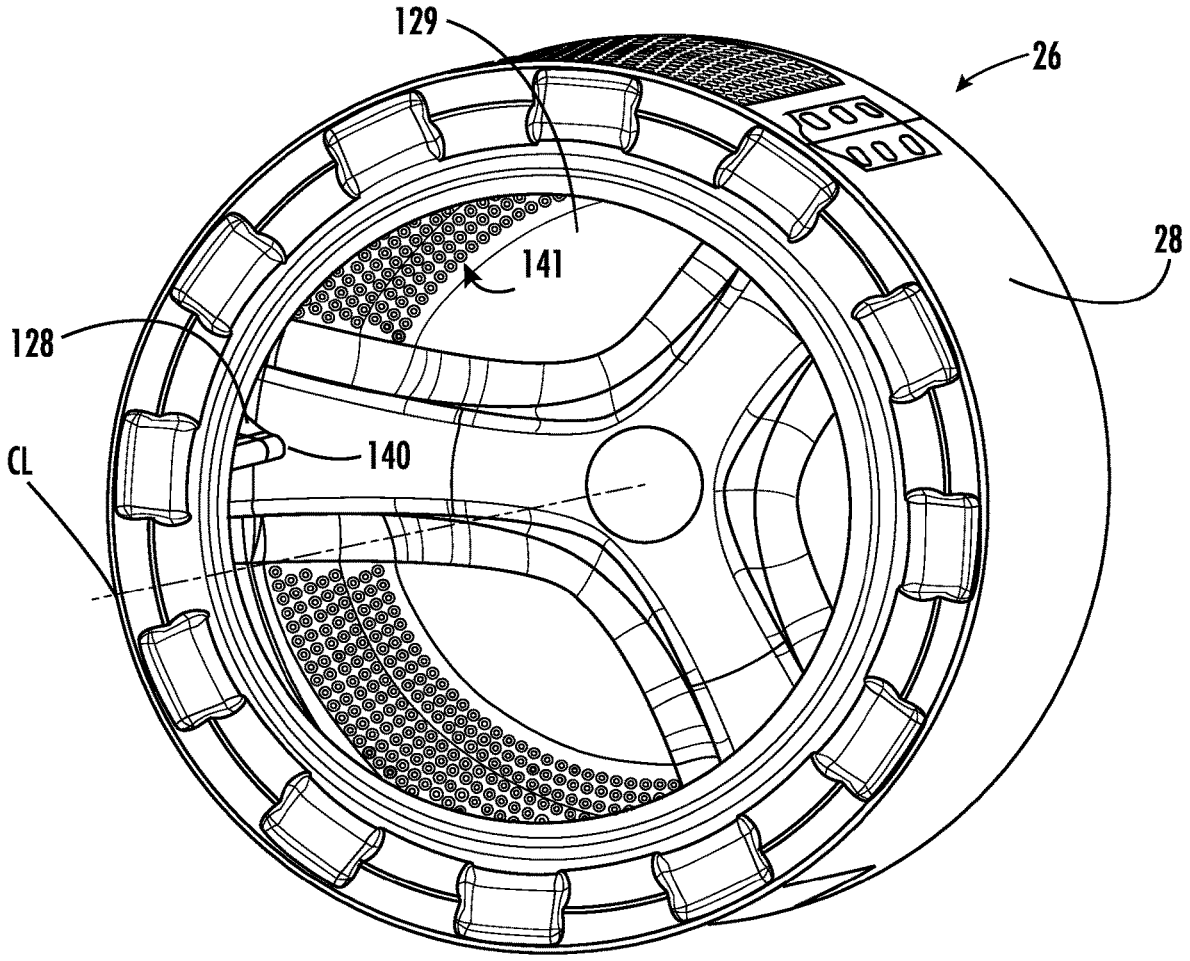
FIG. 3 provides a perspective view of an exemplary drum of the laundry appliance according to one or more embodiments of the present disclosure.
Figure 4:
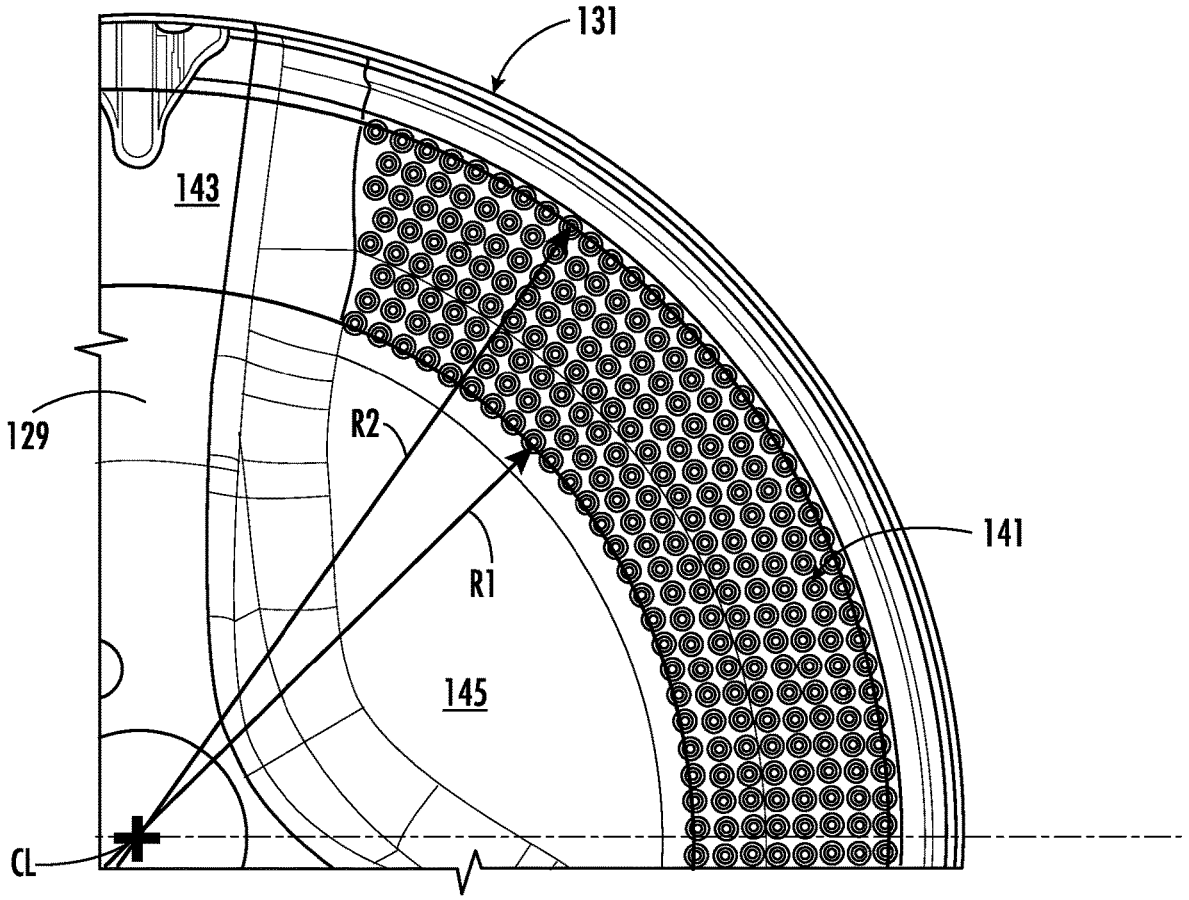
FIG. 4 provides a view of a portion of the exemplary drum of the laundry appliance according to one or more embodiments of the present disclosure.

As illustrated for example in FIGS. 2-4, laundry basket 130 includes a plurality of sidewall perforations 140 extending through sidewall 232, rib 128, or both, in order to facilitate fluid communication between chamber 25 and tub 26, e.g., whereby wash liquid may flow between the tub 26 and the chamber 25 during a wash operation or cycle and/or heated air may flow into the chamber 25 and moisture-laden air may flow out of the chamber 25 during a drying operation or cycle.

Laundry basket 130 includes a plurality of rear wall perforations 141 extending through the rear wall 129. Perforations 140, 141 provide fluid communication from a plenum 126 between the laundry basket 130 and the tub 26.

Referring to FIGS. 3-4, the plurality of rear wall perforations 141 is positioned between a first radius R1 and a second radius R2 relative to the axis of rotation CL. Radius R2 forms an outer radius proximate to the sidewall 131. Radius R1 forms an inner radius distal to the sidewall 131 and more proximate to the axis of rotation CL. In various embodiments, the plurality of rear wall perforations 141 is formed in a region formed between R1 and R2 extending at least 50% of a radial distance from the axis of rotation CL to the sidewall 131. For instance, R1 to R2 may extend between approximately 50% to approximately 100% of the radial distance between the axis of rotation CL and the sidewall 131. In another embodiment, R1 to R2 may extend between approximately 60% to approximately 99% of the radial distance between the axis of rotation CL and the sidewall 131. In still various embodiments, the rear wall 129 is non-perforated (e.g., solid or otherwise non-fluidly communicating) in a region between R1 and the axis of rotation.

A sump 142 is defined by tub 26 outside of laundry basket 130 at a bottom of the tub 26 along the vertical direction V. For instance, sump 142 may be defined between the cylindrical wall 28 and the sidewall 131 of the laundry basket 130. Thus, sump 142 is configured for receipt of, and generally collects, wash liquid (the wash liquid may include, e.g., water, and may also includes additives such as detergents, etc.) during wash operations of laundry appliance 10. For example, during a wash operation of laundry appliance 10, wash liquid may be urged (e.g., by gravity) from the chamber 25 within the laundry basket 130 to sump 142 through the plurality of perforations 140. A pump assembly 40 is located beneath tub 26 for gravity assisted flow when draining tub 26 (e.g., via a drain 41). Pump assembly 40 is also configured for recirculating wash liquid within tub 26.

In some embodiments, laundry appliance 10 includes an additive dispenser or spout 150. For example, spout 150 may be in fluid communication with a water supply (not shown) in order to direct fluid (e.g., clean water) into tub 26. Spout 150 may also be in fluid communication with the sump 142. For example, pump assembly 40 may direct wash liquid disposed in sump 142 to spout 150 in order to circulate wash liquid in tub 26.

As illustrated, a detergent drawer 152 may be slidably mounted within front panel 14. Detergent drawer 152 receives an additive (e.g., detergent, fabric softener, bleach, or any other suitable liquid or powder) and directs the additive to chamber 25 during operation of laundry appliance 10. According to the illustrated embodiment, detergent drawer 152 may also be fluidly coupled to spout 150 to facilitate the complete and accurate dispensing of the additive.

In exemplary embodiments, during operation of laundry appliance 10, laundry items are loaded into laundry basket 130 through opening 32, and an operation is initiated through operator manipulation of input selectors 70. For example, a wash cycle may be initiated such that tub 26 is filled with water, detergent, or other fluid additives (e.g., via spout 150). One or more valves (not shown) can be controlled by laundry appliance 10 to provide for filling laundry basket 130 to the appropriate level for the amount of articles being washed or rinsed. By way of example, once laundry basket 130 is properly filled with fluid, the contents of laundry basket 130 can be agitated (e.g., with ribs 128) for an agitation phase of laundry items in laundry basket 130. During the agitation phase, the basket 130 may be motivated about the axis of rotation at a set speed (e.g., a tumble speed). As the basket 130 is rotated, articles within the basket 130 may be lifted and permitted to drop therein.

After the agitation phase of the washing operation is completed, tub 26 can be drained. Laundry articles can then be rinsed (e.g., through a rinse cycle) by again adding fluid to tub 26, depending on the particulars of the cleaning cycle selected by a user. Ribs 128 may again provide agitation within laundry basket 130. One or more spin cycles may also be used. In particular, a spin cycle may be applied after the wash cycle or after the rinse cycle in order to wring wash liquid from the articles being washed. During a spin cycle, basket 130 is rotated at relatively high speeds. For instance, basket 130 may be rotated at one set speed (e.g., a pre-plaster speed) before being rotated at another set speed (e.g., a plaster speed). As would be understood, the pre-plaster speed may be greater than the tumble speed and the plaster speed may be greater than the pre-plaster speed. Moreover, agitation or tumbling of articles may be reduced as basket 130 increases its rotational velocity such that the plaster speed maintains the articles at a generally fixed position relative to basket 130.

After the spin cycle, a drying operation may begin. A supply duct 82 may be mounted to tub 26 and may extend between tub 26 and a heating assembly or system 80, whereby the tub 26 is downstream of the drying system 80 along the supply duct 82 such that the drying system 80 supplies heated air that has been heated by the drying system 80 to the tub 26 via the supply duct 82 or otherwise removes moisture, such as via a heat exchanger or evaporator 102, filters, or combinations thereof. A return duct 84 may also be mounted to the tub 26 and may extend between tub 26 and the drying system 80 whereby the tub 26 is upstream of the drying system 80 along the return duct 84 such that the drying system 80 receives relatively moist, humid, air from the tub 26 via the return duct 84, e.g., air returns to the drying system 80 from the tub 26, e.g., after flowing over and around articles within the chamber 25, through the return duct 84. The supply duct 82 may be mounted to the tub 26, e.g., at the rear wall 34 thereof as in the illustrated example, or the supply duct 82 may be mounted to the cylindrical wall 28 of the tub 26, such as above the basket 130, similar to the return duct 84 in the illustrated example embodiment.

The drying system 80, may include, e.g., a heating element, a gas burner, and/or a heat pump, such as the example heat pump embodiment illustrated in FIG. 5 and described in more detail below. Moisture laden air is drawn from tub 26 by an air handler, such as a blower fan (e.g., blower 119), which generates a negative air pressure within the chamber 25. As the air passes from the blower fan, it enters return duct 84 and then is passed into drying system 80. Dry and/or heated air (with a lower moisture content than was received from tub 26), exits drying system 80 and is supplied to tub 26 by supply duct 82. When operated during a drying cycle, after the clothing articles have been dried, they are removed from the chamber 25 via opening 32. As provided further herein, portions of the drying system 80 may be operated to generate the negative air pressure to urge the flow of fluid (e.g., a flow of air) from the chamber 25 through the drying system 80 to remove moisture content from the flow of fluid during the spin cycle.

Figure 5:
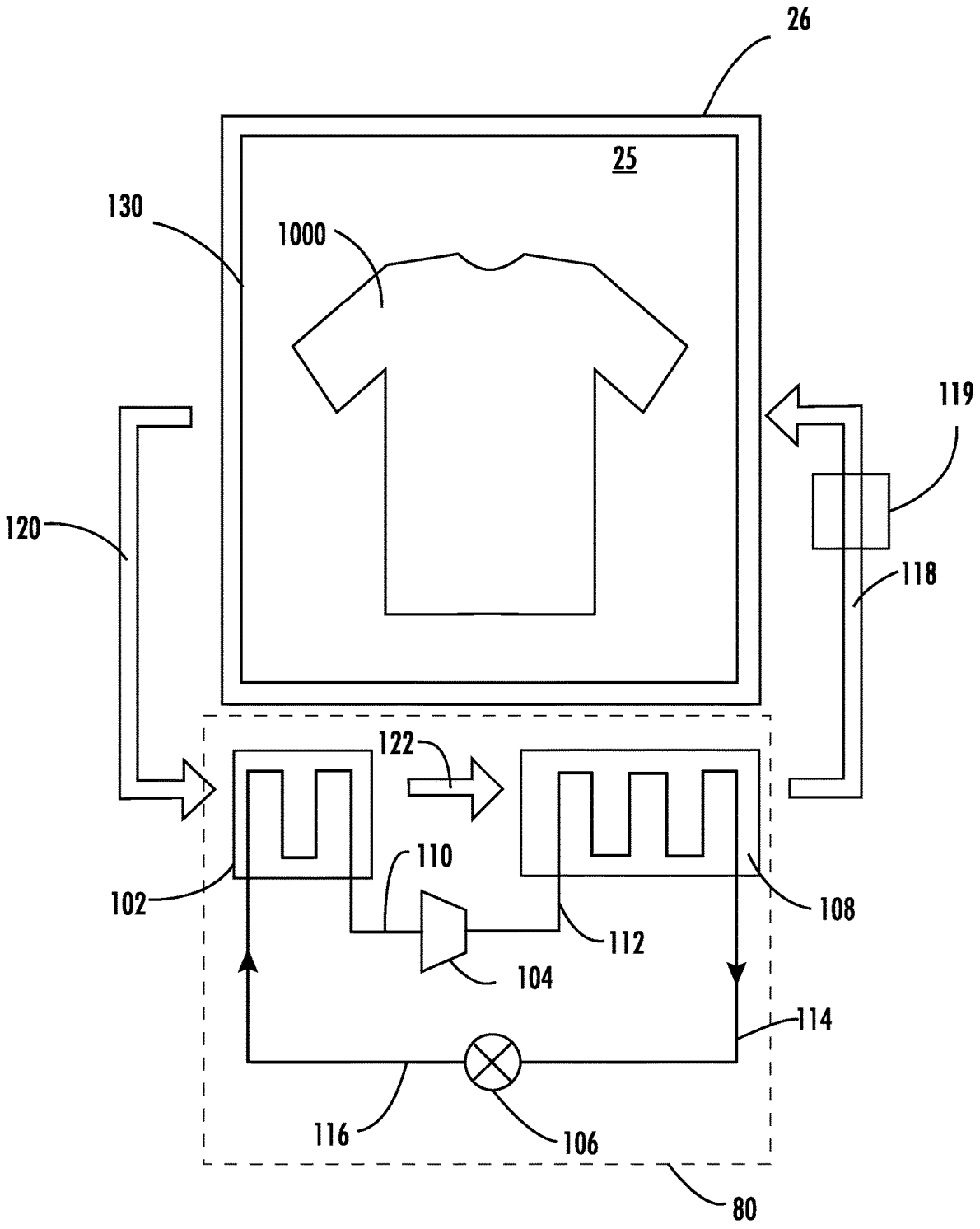
FIG. 5 provides a schematic diagram of an exemplary laundry appliance according to one or more embodiments of the present disclosure.

Turning now to FIG. 5, a schematic view of selected components of one or more exemplary embodiments of laundry appliance 10 is provided. In particular, FIG. 5 illustrates components used during drying operations of the laundry appliance 10. It is understood that, except as otherwise indicated, laundry appliance 10 in FIG. 5 may include some or all of the features described above with respect to FIGS. 1-4.

In operation, one or more laundry articles 1000 may be placed within the chamber 25 of laundry basket 130. Dry air 118 (e.g., hot dry air during operation of the drying cycle, or dry air during operation of the spin cycle) may be supplied to chamber 25 whereby moisture within laundry articles 1000 may be drawn from the laundry articles 1000 by evaporation, such that warm saturated air 120 may flow from chamber 25 to a heat exchanger or evaporator 102 of the drying system 80, e.g., via the return duct 84 illustrated in FIG. 2. As air passes across evaporator 102, the temperature of the air is reduced through heat exchange with refrigerant that is vaporized within, for example, coils or tubing of evaporator 102. This vaporization process absorbs both the sensible and the latent heat from the moisture laden air-thereby reducing its temperature. As a result, moisture in the air is condensed and such condensate may be drained from dryer system 80, as will be understood by those of ordinary skill in the art.

Air passing over evaporator 102 becomes drier and cooler than when it was received from tub 26 of laundry appliance 10. As shown, cool dry air 122 from evaporator 102 is subsequently caused to flow across a condenser 108 (e.g., across coils or tubing of the condenser 108), which condenses refrigerant therein. The refrigerant enters condenser 108 in a gaseous state at a relatively high temperature compared to the air 122 from evaporator 102. As a result, heat energy is transferred to the air at the condenser section 108, thereby elevating the temperature of the air and providing warm dry air 118 for supply to the tub 26 of washer/dryer appliance 10. e.g., via the supply duct 82 illustrated in FIG. 2. The warm dry air 118 passes over and around laundry articles 1000 within the chamber 25 of the tub 26, such that warm saturated air 120 is generated, as mentioned above. For example, the warm dry air may circulate around and through the articles 1000 while the articles 1000 are tumbled within the chamber 25 such as by rotating the basket 130, and the tumbling may be promoted by ribs 128 as well. Because the air is recycled through tub 26 and drying system 80, laundry appliance 10 can have a much greater efficiency than traditional clothes dryers where warm, moisture laden air is exhausted to the environment.

As shown, some embodiments of drying system 80 include a compressor 104 that pressurizes refrigerant (i.e., increases the pressure of the refrigerant) supplied by suction line 110 and generally motivates refrigerant through the sealed refrigerant circuit of drying system 80. Compressor 104 may be in operable communication with controller 56 and is generally designed to pressurize a gas phase refrigerant. Accordingly, in order to avoid damage, refrigerant in suction line 110 is supplied to the compressor 104 in a gas phase from the evaporator section 102. The pressurization of the refrigerant with compressor 104 increases the temperature of the refrigerant (e.g., as directed by controller 56). The compressed refrigerant is fed from compressor 104 to condenser 108 through line 112. As relatively cool air 122 from the evaporator 102 is passed over the condenser 108, the refrigerant is cooled and its temperature is lowered as heat is transferred to the air for supply to tub 26.

Upon exiting condenser 108, the refrigerant is fed through line 114 to an expansion device 106. Although only one expansion device 106 is shown, such is by way of example only. It is understood that multiple such devices may be used. In the illustrated example, expansion device 106 is a thermal expansion valve. In additional embodiments, any other suitable expansion device, such as a capillary tube, may be used as well as or instead of the thermal expansion valve 106. Expansion device 106 lowers the pressure of the refrigerant and controls the amount of refrigerant that is allowed to enter the evaporator 102 via line 116. Importantly, the flow of liquid refrigerant into evaporator 102 is limited by expansion device 106 in order to keep the pressure low and allow expansion of the refrigerant back into the gas phase in the evaporator 102. The evaporation of the refrigerant in the evaporator 102 converts the refrigerant from its liquid-dominated phase to a gas phase while cooling and drying the air 120 from tub 26. The process is repeated as air is circulated through tub 26 and between evaporator 102 and condenser 108 while the refrigerant is cycled through the sealed refrigerant circuit, as described above.

In various embodiments, a fan or blower 119 is positioned along an air flowpath of the hot dry air 118, the saturated air 120, or the cool dry air 122. In an exemplary embodiment, the blower 119 is positioned in fluid communication with hot dry air 118 exiting thermal communication with the condenser 108. In another embodiment, the blower 119 may be positioned in fluid communication with saturated air 120 exiting the chamber 25. In still another embodiment, the blower 119 may be positioned in fluid communication with cool dry air 122 fluidly between the evaporator 102 and the condenser 108. The blower 119 is configured to push, draw, or otherwise urge a flow of air to the chamber 25, such as further described herein.

A high pressure region 143 is formed radially outward of R1 when the laundry basket 130 spins. A relatively low pressure region 145 is formed between radius R1 and the axis of rotation CL. Within the laundry basket 130, the high pressure region 143 is formed between R1 and the sidewall 131.

Figure 7:
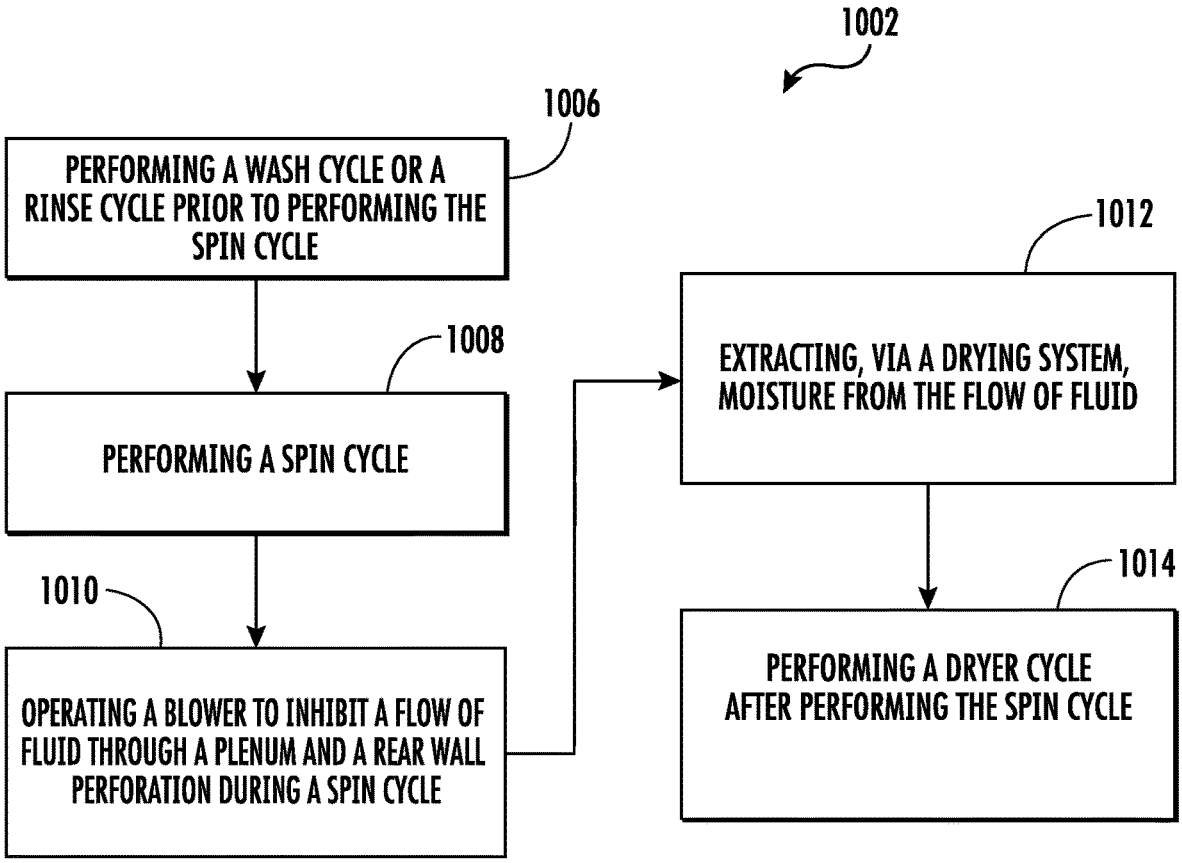
FIG. 7 provides a flowchart outlining steps of a method for operating a combination washer/dryer appliance in accordance with aspects of the present disclosure.

Referring now to FIG. 7, a flowchart outlining exemplary steps of a method for operating a combination washer/dryer appliance is provided (hereinafter, "method 1002"). Embodiments of method 1002 may be stored as instructions at controller 56 and executed by embodiments of the laundry appliance 10 such as depicted and described herein. Embodiments of the method 1002 described herein may improve airflow at a combination washer/dryer laundry appliance (e.g., laundry appliance 10), such as to improve moisture reduction of laundry articles by the spin cycle, such as to reduce moisture content of laundry articles prior to commencing a drying cycle.

Embodiments of the method 1002 include at 1008 performing a spin cycle, such as corresponding to a wash cycle. In an exemplary cycle, the washer motor is rotated at a speed greater than zero during a spin cycle of the laundry appliance, such as to rotate the wash basket up to a wash cycle maximum spin speed (e.g., up to approximately 1300 RPM). Those of ordinary skill in the art will recognize that the spin cycle is generally performed at the end of a wash cycle or wash operation of a laundry appliance, and the wash cycle generally includes at least one fill, such as a wash fill followed by a drain stage and a rinse fill, where a flow of liquid, e.g., water and/or wash liquid (water plus one or more additives such as detergent), is provided into the tub of the laundry appliance. The spin cycle is thus performed after the at least one fill in order to wring liquid from laundry articles within the laundry basket 130. In various embodiments, wash cycle spin speed may be a function of diameter of the wash basket (e.g., smaller diameter wash baskets may spin at greater speeds than larger diameter wash baskets).

Figure 6:
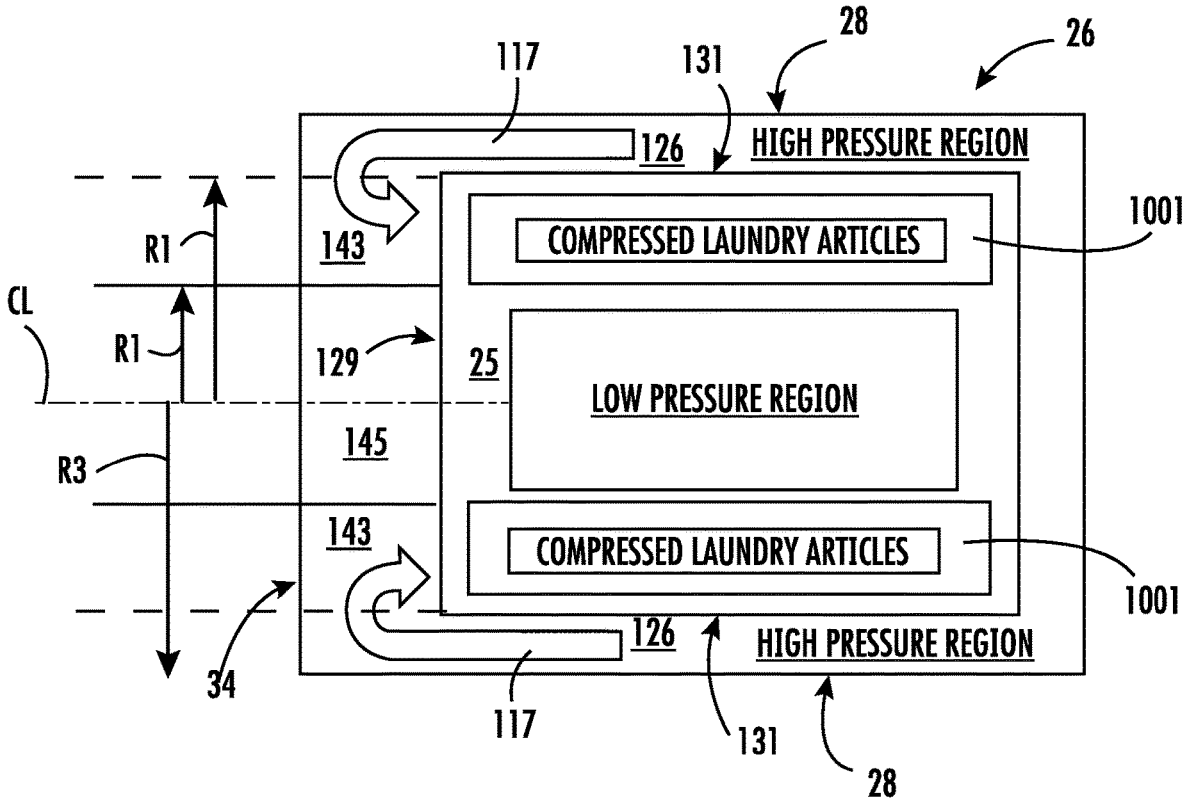
FIG. 6 provides a schematic diagram of the exemplary drum of the laundry appliance during operation of one or more embodiments of the present disclosure.

Performing the spin cycle may generate a high pressure region (e.g., region 143) at the plenum 126 and a relatively low pressure region (e.g., region 145) radially inward of the high pressure region. The spin cycle compresses laundry articles against the sidewalls 131 of the laundry basket 130, which cause moisture to flow from laundry articles 1001 through perforations 140, such as depicted in FIG. 6. Perforations 141 through the rear wall 129 allow for airflow through the chamber 25 when the laundry articles 1001 are compressed against perforations 140 at the sidewall 131. The spin cycle generates a flow of air which may cause moist air to recirculate from the high pressure region 143 through perforations 141 at the rear wall 129 back into the chamber 25, such as depicted schematically via arrows 117 in FIG. 6.

Embodiments of the method 1002 include at 1010 operating a blower (e.g., blower 119 in FIG. 5) to inhibit a flow of fluid (e.g., air) through a rear wall perforation (e.g., perforation 141) and a plenum formed between the laundry basket and the tub (e.g., plenum 126) during a spin cycle. Step 1010 may be commenced during the spin cycle, or prior to commencement of the spin cycle. The blower 119 is operated during at least a portion of the spin cycle. Blower 119 is operated during the spin cycle to minimize water recirculation between the laundry basket 130 and the tub 26 (e.g., plenum 126). The blower 119 reduces or eliminates a pressure differential between the high pressure region 143 and the low pressure region 145. Operation of the blower 119 during the spin cycle may reduce or eliminate the pressure differential (e.g., approximately zero pressure differential) between the laundry basket 130 and plenum 126. Operation of heat exchangers, evaporators, and filters at the drying system 80 may capture moisture and return the moisture through sump 142, removing moisture from the air and reducing circulation of moist air to the laundry articles. Operation of the blower 119 during the spin cycle may reduce or mitigate recirculation of moist air within the plenum 126 or chamber 25.

Some embodiments of the method 1002 may include at 1006 performing a wash cycle or a rinse cycle prior to performing the spin cycle. Method 1002 may include at 1012 extracting, via the drying system (e.g., drying system 80), moisture from the flow of fluid provided from operating the blower during the spin cycle. In still various embodiments, method 1002 includes at 1014 performing a dryer cycle (e.g., via operation of the drying system 80 to generate heated, dry air, such as described herein) after performing the spin cycle. In some embodiments, performing the dryer cycle includes spinning the laundry basket up to a dyer cycle maximum speed (e.g., up to approximately 500 revolutions per minute (RPM), or equivalent to approximately 1 g acceleration), and operating the drying system to flow heated dry air to chamber. For example, dryer spin speed may be configured to carry the load of clothing articles to the top of the tub and have it free fall through the tub, such as to allow for fluff and uniform drying.

Embodiments of the washer/dryer appliance 10 and method 1002 provided herein may improve efficiency and performance of combination washer/dryer appliances by reducing moisture content from laundry articles during the spin cycle. Reduced moisture content may allow for reduced drying times and reduced energy consumption (e.g., reduced thermal input, reduced spin cycle time, reduced dryer tumble time, reduced cycle times generally, etc.). Embodiments of the washer/dryer appliance 10 may advantageously increase energy consumption via operation of the blower 119 during the spin cycle to facilitate an unexpectedly reduced net energy consumption of the overall washer/dryer cycle, such as through reduced spin cycle time, reduced dryer cycle time, or both, resulting from reduced moisture content in laundry articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combination washer/dryer laundry appliance, comprising:

a cabinet defining an interior volume;

a tub mounted within the interior volume of the cabinet;

a laundry basket rotatably mounted within the tub, the laundry basket defining a chamber for the receipt of laundry articles, the laundry basket comprising a rear wall perforation in fluid communication with a plenum formed between the laundry basket and the tub;

a drying system coupled to the tub, the drying system in fluid communication with the chamber, the drying system configured to receive a flow of fluid from the chamber and remove moisture from the flow of fluid and provide the dried air to the chamber;

a blower positioned at a flowpath comprising the drying system and the chamber, the blower configured to urge the flow of fluid through the flowpath; and a controller, the controller configured to store instructions that, when executed, causes the controller to execute operations, the operations comprising:

performing, at the laundry basket, a spin cycle; and operating the blower to inhibit the flow of fluid through the plenum and rear wall perforation during the spin cycle.

2. The combination washer/dryer laundry appliance of claim 1, wherein performing the spin cycle comprises rotating the laundry basket up to a wash cycle maximum speed.

3. The combination washer/dryer laundry appliance of claim 2, wherein rotating the laundry basket up to the wash cycle maximum speed generates a high pressure region at the plenum between the laundry basket and the tub and a low pressure region radially inward of the high pressure region.

4. The combination washer/dryer laundry appliance of claim 3, wherein operating the blower reduces a pressure differential between the high pressure region and the low pressure region to approximately zero.

5. The combination washer/dryer laundry appliance of claim 1, wherein the laundry basket comprises a sidewall and a rear wall, and wherein the sidewall and the rear wall each comprises a plurality of perforations extending therethrough to provide fluid communication between the chamber and a plenum between tub and the laundry basket.

6. The combination washer/dryer laundry appliance of claim 1, the operations comprising:

extracting, via the drying system, moisture from the flow of fluid.

7. The combination washer/dryer laundry appliance of claim 1, the drying system comprising:

a heat exchanger positioned in thermal communication at the flowpath, the heat exchanger configured to extract moisture from the flow of fluid.

8. The combination washer/dryer laundry appliance of claim 1, the operations comprising:

performing a wash cycle or a rinse cycle prior to performing the spin cycle.

9. The combination washer/dryer laundry appliance of claim 8, the operations comprising:

performing a dryer cycle after performing the spin cycle.

10. The combination washer/dryer laundry appliance of claim 9, wherein performing the dryer cycle comprises:

spinning the laundry basket up to a dryer cycle maximum speed less than the wash cycle maximum speed; and operating the drying system to flow heated dry air to chamber.

11. A controller for a combination washer/dryer laundry appliance, the controller configured to store instructions that, when executed, causes the combination washer/dryer laundry appliance to perform operations, the operations comprising:

performing, at a laundry basket, a spin cycle corresponding to a wash operation; and operating a blower positioned at a flowpath comprising a drying system and a chamber at which laundry articles are received, the blower configured to urge the flow of fluid through the flowpath, wherein operating the blower comprises operating the blower to inhibit a flow of fluid during the spin cycle through a rear wall perforation of the laundry basket fluidly connected with a plenum formed between the laundry basket and a tub.

12. The controller of claim 11, wherein performing the spin cycle comprises rotating the laundry basket up to a wash cycle maximum speed.

13. The controller of claim 12, wherein rotating the laundry basket up to the wash cycle maximum speed generates a high pressure region at a plenum between the laundry basket and a tub surrounding the laundry basket, and further generating a low pressure region radially inward of the high pressure region.

14. The controller of claim 13, wherein operating the blower reduces a pressure differential between the high pressure region and the low pressure region to approximately zero.

15. The controller of claim 11, wherein the laundry basket comprises a sidewall and a rear wall, and wherein the sidewall comprises a sidewall perforation, and wherein the rear wall comprises the rear wall perforation, the sidewall and rear wall perforations extending therethrough to provide fluid communication between the chamber and the plenum between the tub and the laundry basket.

16. The controller of claim 11, the operations comprising:

extracting, via the drying system, moisture from the flow of fluid provided from operating the blower during the spin cycle.

17. The controller of claim 16, the operations comprising:

extracting, via a heat exchanger positioned in thermal communication with the flow of fluid from the chamber, moisture from the flow of fluid.

18. The controller of claim 11, the operations comprising:

performing a wash cycle or a rinse cycle prior to performing the spin cycle.

19. The controller of claim 18, the operations comprising:

performing a dryer cycle after performing the spin cycle.

20. The controller of claim 19, wherein performing the dryer cycle comprises:

spinning the laundry basket up to a dryer cycle maximum speed less than a wash cycle maximum speed; and operating the drying system to flow heated dry air to the chamber.

* * * * *